US006619540B1

(12) United States Patent
Bazany

(10) Patent No.: US 6,619,540 B1
(45) Date of Patent: Sep. 16, 2003

(54) SNAP LOCK TOTE BOX HANDLE AND TOTE BOX CONSTRUCTION

(75) Inventor: Donald J. Bazany, Grand Haven, MI (US)

(73) Assignee: Bradford Company, Holland, MI (US)

( * ) Notice: Subject to any disclaimer, the term of this patent is extended or adjusted under 35 U.S.C. 154(b) by 0 days.

(21) Appl. No.: 10/127,781

(22) Filed: Apr. 22, 2002

(51) Int. Cl.[7] ..... B65D 5/44

(52) U.S. Cl. ..... 229/199; 220/642; 220/767; 220/769; 220/770; 229/117.16; 229/117.24; 229/117.26; 493/88; 493/89; 493/136; 493/909

(58) Field of Search ..... 229/117.16, 117.23, 229/117.24, 117.26, 198.1, 199; 220/4.28, 4.33, 641, 642, 646, 651, 652, 756, 767, 769, 770; 206/509, 512; 493/88, 89, 114, 115, 136, 909

(56) References Cited

U.S. PATENT DOCUMENTS

| | | | | |
|---|---|---|---|---|
| 1,241,633 | A | | 10/1917 | Johnson |
| 1,682,028 | A | | 8/1928 | Young |
| 2,191,291 | A | | 2/1940 | Smith |
| 2,206,314 | A | | 7/1940 | Werner |
| 2,225,958 | A | | 12/1940 | Mandel |
| 2,304,853 | A | | 12/1942 | Shaw |
| 2,347,725 | A | | 5/1944 | Zalkind |
| 2,359,335 | A | | 10/1944 | Stuart et al. ..... 229/5.7 |
| 2,419,842 | A | | 4/1947 | Lebold ..... 224/45 |
| 2,544,283 | A | | 3/1951 | Snyder |
| 2,610,756 | A | * | 9/1952 | Best ..... 220/641 |
| 2,771,235 | A | | 11/1956 | Stephenson |
| 2,801,786 | A | | 8/1957 | Foster |
| 2,941,710 | A | | 6/1960 | Smith et al. |
| 2,947,462 | A | | 8/1960 | Bostock |
| 2,954,914 | A | | 10/1960 | Herlihy |
| 2,961,139 | A | | 11/1960 | Nobili |

(List continued on next page.)

*Primary Examiner*—Gary E. Elkins
(74) *Attorney, Agent, or Firm*—Wood, Herron & Evans, LLP

(57) ABSTRACT

A tote box is comprised of a box structure having a bottom and upstanding side walls, each of the side walls having upper edges which form a top edge of the box structure. A top rail extends around the top edge of the box structure, the top rail having an open channel formed between a pair of channel walls, with the channel positioned over the top edge. An aperture is formed in at least one of said side walls of the box structure. A handle is positioned to engage the aperture in the side wall to form a handle for the box structure. The handle includes a flange extending along the side wall proximate the top edge, and a portion of the flange is positioned within the open channel of the top rail. A protruding structure extends from the flange and is configured to engage the top rail and secure the handle in the top rail and box structure.

24 Claims, 6 Drawing Sheets

U.S. PATENT DOCUMENTS

| | | | | | |
|---|---|---|---|---|---|
| 3,226,008 | A | | 12/1965 | Chiorri | |
| 3,279,676 | A | | 10/1966 | Cornish | |
| 3,331,527 | A | | 7/1967 | Kaas et al. | |
| 3,512,696 | A | | 5/1970 | Ebert | |
| 3,622,037 | A | | 11/1971 | Gildart | |
| 3,647,101 | A | | 3/1972 | Hensch et al. | 220/4 |
| 3,659,774 | A | | 5/1972 | Mielke | |
| 3,687,168 | A | | 8/1972 | Sherman et al. | 138/109 |
| 3,797,727 | A | | 3/1974 | Downing et al. | |
| 4,068,794 | A | | 1/1978 | Lawrence | |
| 4,095,719 | A | | 6/1978 | Wolf | 220/4 |
| 4,172,623 | A | | 10/1979 | Anderson | 312/244 |
| 4,210,274 | A | | 7/1980 | Leonard | |
| 4,359,183 | A | | 11/1982 | Aida et al. | |
| 4,503,973 | A | | 3/1985 | Andersson | 206/386 |
| 4,524,902 | A | | 6/1985 | Mortimer | |
| 4,572,368 | A | | 2/1986 | Miller et al. | 206/328 |
| 4,619,371 | A | | 10/1986 | Rehrig | 220/71 |
| 4,624,380 | A | | 11/1986 | Wernette | 220/6 |
| 4,693,387 | A | | 9/1987 | Stonier | 220/6 |
| 4,787,515 | A | | 11/1988 | Stoll | 206/509 |
| 4,848,580 | A | | 7/1989 | Wise | 206/519 |
| 4,971,201 | A | | 11/1990 | Sathre | 206/509 |
| 5,033,669 | A | | 7/1991 | Federico | 229/198.1 |
| 5,037,027 | A | | 8/1991 | Nichols | 229/198.1 |
| 5,074,461 | A | | 12/1991 | Parker et al. | 229/125.13 |
| 5,193,701 | A | * | 3/1993 | Bush et al. | 220/4.33 |
| 5,295,632 | A | | 3/1994 | Zink et al. | 229/198 |
| 5,462,221 | A | * | 10/1995 | Zink et al. | 229/117.26 |
| 5,522,539 | A | * | 6/1996 | Bazany | 229/199 |
| 6,116,452 | A | * | 9/2000 | Hamel et al. | 220/756 |
| 6,305,601 | B1 | * | 10/2001 | Bazany et al. | 229/199 |
| 6,349,877 | B1 | * | 2/2002 | Bradford | 493/89 |
| 6,460,724 | B1 | * | 10/2002 | Bradford | 220/642 |

* cited by examiner

10

SNAP LOCK TOTE BOX HANDLE AND TOTE BOX CONSTRUCTION

FIELD OF THE INVENTION

This invention relates to tote boxes, and more particularly to a handle and construction which is used in single or double ply tote box walls.

BACKGROUND OF THE INVENTION

Traditionally, containers which are returnable and reusable have been used for transportation, storage, and display of goods in commerce, such as in a manufacturing and/or assembly line environment. One such class of containers, which are manually portable, are commonly referred to as "tote boxes." Tote boxes must be of a sufficiently rigid construction to enable the safe and damage-free transport and storage of the goods which are contained therein. Various tote boxes are designed so as to be stacked or mounted in a nesting relationship for convenient transportation or storage thereof. In order to be stackable, the upper edge of the tote box is typically reinforced with a top rail or rim member which is adapted to receive another tote box stacked thereupon.

A variety of materials are traditionally utilized in the construction of such tote boxes. Such materials may include corrugated paperboard, corrugated plastic sheet, sheet metal, and other such materials. A light weight, yet stackable strength, is desired. Often such wall materials are too thin to support a number of filled tote boxes in a stacked relationship. Therefore, some tote box constructions utilize reinforcing structures, such as reinforced corners. In that way, a lower tote box of a stack can kinetically support the load of a plurality of upper tote boxes having goods therein without deformation. U.S. Pat. Nos. 5,295,632 and 5,462,221, assigned to the assignee of this invention, disclose various tote box designs.

Tote boxes are generally manually portable, to be moved around between locations, whether full of goods or empty. For the convenient lifting and handling of the tote box, a handle structure or handhold is typically provided on the tote box. For example, one type of handhold comprises a simple cutout in one or more side walls of the tote box, through which a user can insert their hand for lifting and/or carrying the tote box and its contents. In another design, a plastic handle may be snap fit into the cutout to cover any sharp or rough edges of the cutout and to thereby provide a more comfortable handhold for the user. Furthermore, plastic handles may strengthen the tote box at the handhold to prevent the ripping or tearing of the tote box wall material.

However, existing formed handholds or handles which are fit into the cutouts of tote boxes have some drawbacks. Generally, the handles are made of a molded plastic for ease of manufacturing and low cost. Also, the plastic handholds or handles have been relatively flexible so that they could be inserted easily into the cutouts. However, their flexibility has contributed to their tendency to become dislodged from the tote box. The handles are frequently pulled from the cutouts into which they were inserted when the tote box was filled with goods and being lifted or carried by someone grasping at the handles.

Solutions have been offered for such drawbacks, such as by the tote box handle disclosed in U.S. Pat. No. 5,462,221, which is incorporated herein by reference in its entirety. However, it is still desirable to improve on handle structures for tote boxes.

Specifically, it is an objective of the invention to provide a tote box handle and overall tote box construction which may incorporate other support structures of the tote box, in addition to the cutout of the side wall, for further strength and durability of the handle.

Another objective of the invention is to provide a tote box handle which can be readily incorporated into an existing tote box design without significant redesign of the tote box.

It is still another objective of the present invention to provide a tote box with a handle which is easily and economically manufactured.

It is a further objective of the present invention to reduce the amount of time and expense required to assemble a tote box with such a handle structure.

These objectives, and other objectives, will become more readily apparent from the invention as described in greater detail hereinbelow.

SUMMARY OF THE INVENTION

In accordance with the present invention, a tote box is provided which comprises a box structure having a bottom and upstanding side walls. Each of the side walls define upper edges which form a top edge of the box structure. An aperture is formed in at least one of the side walls of the box structure. In accordance with one aspect of the present invention, a handle is positioned to engage the aperture in the sidewall to form a handle for the box structure. A protruding structure extends from the portion of the flange proximate to the top edge.

The tote box further comprises a top rail which extends around the top edges of the box structure. The top rail defines an open channel which is formed between a pair of channel walls. The channel is positioned over the top edge, and the protruding structure is configured to engage the top rail, and to specifically engage a channel wall of the top rail, to secure the handle in the top rail, secure the top rail to the tote box, and to the secure the handle to the box structure. In one embodiment, an inwardly extending hook on a bottom edge of at least one of the channel walls is engaged by the protruding structure for securing the handle and the box structure with the top rail or other structure extending around the top edge of the tote box. In another embodiment, multiple protruding structures might be utilized to engage the top rail.

The protruding structure might take various suitable forms. For example, in one embodiment, the protruding structure includes a tongue which is angled from a flange of the handle in order to engage the top rail. In another embodiment, the protruding structure includes an indent which extends toward one of the channel walls to engage that channel wall. In still another embodiment, ribs are utilized. First and second flanges in one embodiment extend substantially around t he handle and the aperture, to stabilize the handle within the aperture and further strengthen the handle.

In one embodiment, the protruding structure(s), may be formed integrally with the handle. For example, the handle may include a flange and the protruding structure may extend from the handle. Alternatively, the protruding structure(s) may be a separate piece from the handle, and they may be coupled or otherwise secured together in the completed assembly by suitable means.

In that way, the present invention provides a tote box construction and a handle which is easily and economically manufactured, may be readily assembled, and is configured to stay within the aperture and prevent the handle from being pulled out when the tote box is utilized and carried. Furthermore, the present invention may be readily incorporated into existing tote boxes. Still further, the interaction of the handle with the top rail or other edge structure provides further strength and durability for the tote box and for the handle. Further details of the disclosed possible embodiments of the invention are set forth hereinbelow.

BRIEF DESCRIPTION OF THE DRAWINGS

The accompanying drawings, which are incorporated in and constitute a part of this specification, illustrate embodiments of the invention and, together with a general description of the invention given below, serve to explain the principles of the invention.

DETAILED DESCRIPTION OF THE INVENTION

Figure 1:
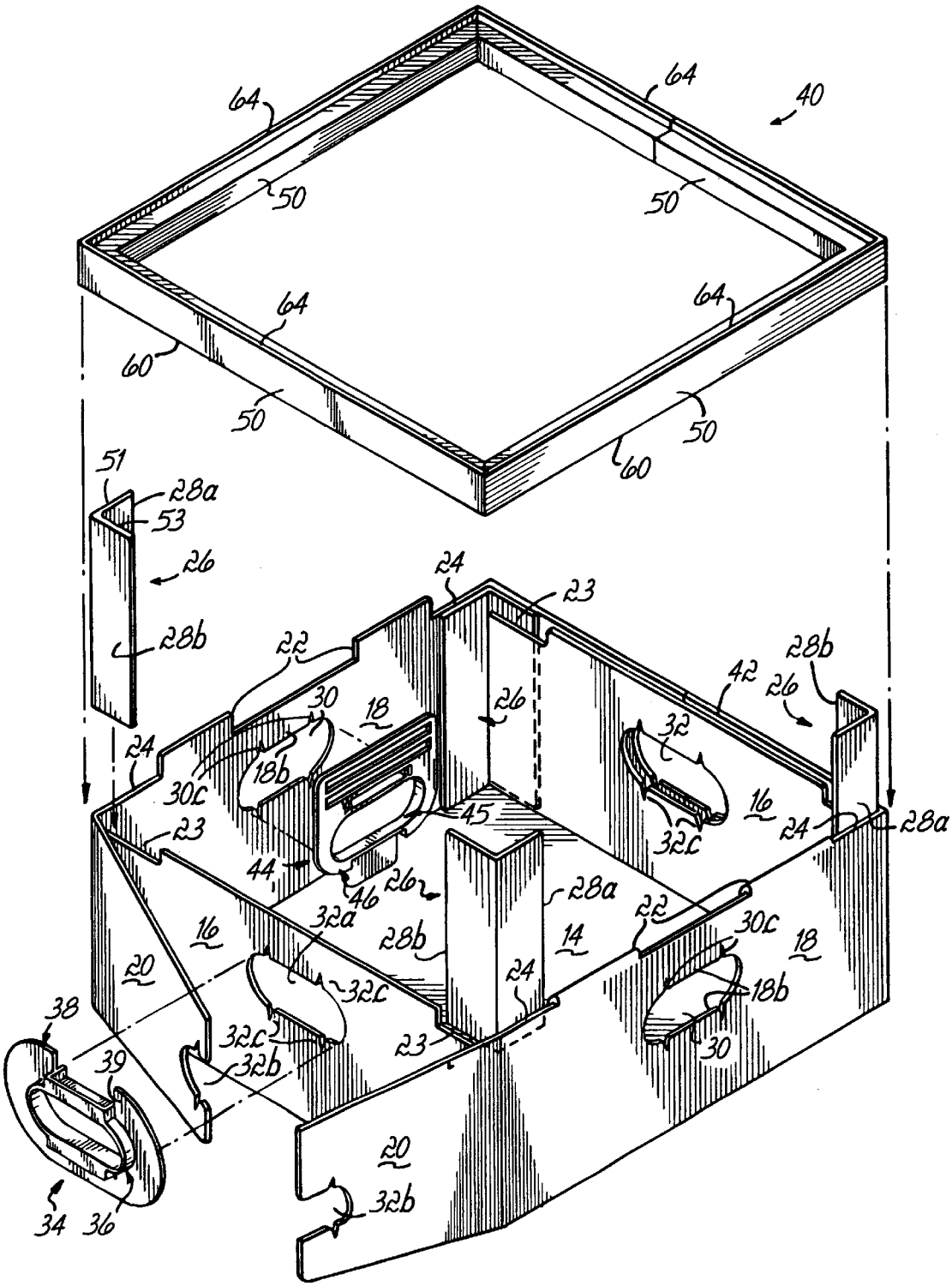
FIG. 1 is a partially exploded view of one possible tote box which may be used in accordance with the principles of the present invention.

Referring now to FIG. 1, one embodiment of a tote box 10, suitable for the present invention, is shown. Of course, other tote box and container designs may be suitable for use with the present invention.

For example, the tote box illustrated in FIG. 1 is shown to have at least two walls which are double ply. However, the invention may also be utilized with tote boxes having all walls which are a single ply. Furthermore, the box 10 has handles 34 for the double-ply walls. However, all handles might be similar to those described in the embodiments of the invention as disclosed herein. Therefore, the present invention is not limited to the example tote box as illustrated in FIG. 1, and any or of the handles, including all four or more handles of the box, might incorporate the aspects of the present invention.

The tote box embodiment 10, as an example, is described in detail herein and in U.S. Pat. No. 5,462,221 and may be assembled from a uniform thickness box blank 12 (FIG. 2) which is die cut or otherwise precut from various materials, such as corrugated plastic sheet. In one embodiment, the box blank 12 has a bottom 14, two end walls 16 connected to the bottom 14 by fold lines 16*a*, two side walls 18 connected to the bottom 14 by fold lines 18*a*, and end flaps 20 which are lateral extensions of the side walls 18 and are connected thereto by fold lines 20*a*. Notches 23 are provided in the uppermost corners of each end wall 16 to facilitate the construction of the tote box 10 as described later in this disclosure. The box blank 12 also includes tabs 22 which are extensions on an uppermost edge 24 of the erected side wall 18 and are connected to the top edge of the side walls 18 by fold lines 22*a*. The tabs 22 are downwardly folded onto the side walls 18, as shown in FIG. 1. However, because of the unique aspects of the invention, the tabs 22 may not be necessary, and therefore, the present invention is not limited to use in boxes which have tabs.

Four corner enhancers 26 may be used in an embodiment of the tote box 10. These corner enhancers 26 are preferably made of plastic or aluminum. Each corner enhancer 26 has two equal length legs 28*a*, 28*b* which are substantially normal to one another and are of a height approximately equal to the height of the side and end walls 16, 18. The corner enhancers 26 add strength and structural rigidity to the tote box 10 and support the weight of other tote boxes stacked thereon. Of course, depending on the construction of the tote box, such enhancers may not be utilized. Therefore, the invention is not limited to tote boxes with enhanced corners.

Figure 3:
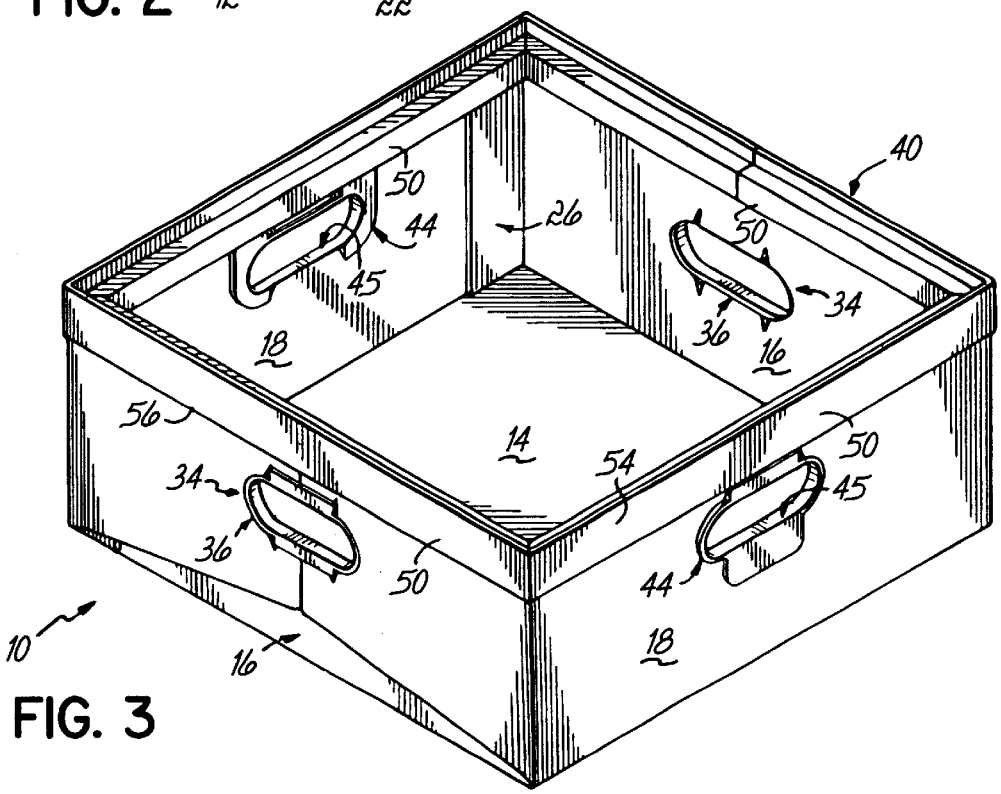
FIG. 3 is a perspective view of an assembled tote box as in FIG. 1.

The side walls 18 and end walls 16 of the tote box 10 also include cutouts, or apertures centrally located on each wall, as shown particularly in FIGS. 1 and 3. In the embodiment of the tote box 10, the side walls 18 are single ply and therefore aperture 30 extends through only a single thickness of the corrugated box blank 12. The end walls 16 are double ply; therefore apertures 32 in the end walls 16 include aperture 32*a* in the end wall 16 and a cutout 32*b* in each end flap 20 which is essentially one-half of the aperture so that when the complementing end flaps 20 are folded against the end wall 16, an aperture identical in size to the aperture 32*a* in the end wall 16 is formed. The apertures 30, 32 are each preferably provided with four triangular notches 30*c*, 32*c* extending therefrom with two of the notches being provided on the top side of each oval aperture 30, 32 and two notches on the bottom side.

Figure 4:
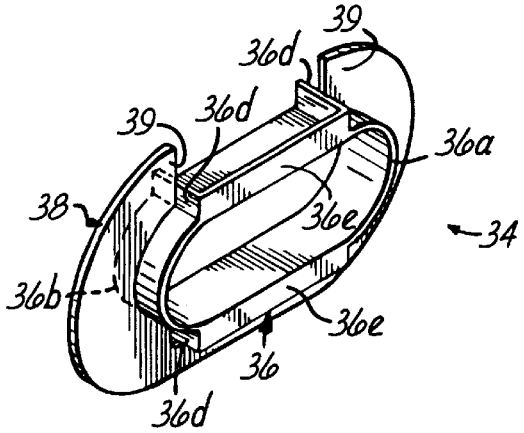
FIG. 4 is a perspective view of one embodiment of a handle in the tote box in FIG. 1.

The apertures 32, 30 in the walls 16,18 of the tote box 10 are adapted to receive therein a handle 34. The present invention is particularly useful in single-ply walls. However, a handle 34, for two-ply walls, which might be used in combination with the inventive handle structure, is described briefly by way of background. The handle 34 is securely held in the tote box 10 against inadvertent removal or dislodgement during the lifting or use of the tote box 10. One embodiment of such a handle 34 is shown in FIGS. 3 and 4, and is configured to be positioned in the multiple ply end walls 16. The handle 34 includes a generally oval grip 36 which projects perpendicularly with respect to a generally oval flange 38 extending around the entire perimeter of the grip 36. The outer periphery of the grip 36 is dimensioned for a snap-fit insertion into the oval aperture 32*a* in the end wall 16 of the tote box 10. The flange 38 projects from the grip 36 and is centered thereon such that portions 36*a*, 36*b* of the grip 36 project perpendicularly with respect to the opposing faces of the flange 38 as can be seen in FIGS. 1 and 4. On the top and bottom sides of the grip 36, there are a pair of spaced transverse ribs 36*d* interconnected on the front or outside face of the grip by a longitudinally extending rib 36*e*. On the top side of the handle 34, the flange 38 has an opening or cutout between the transverse ribs 36*d*, 36*d* facing the inside of the tote box 10 as seen in FIG. 1.

Before the end flaps 20 are folded onto the end wall 16, the handle 34 is inserted into the aperture 32*a* in the end wall 16, so that the portion 36*b* of the grip 36 projecting from the face of the flange 38 is inserted into the aperture 32*a* in the end wall 16 with the ribs 36*d* being received in the triangular-shaped notches 32*c* of the aperture. With the handle 34 inserted into the aperture 32*a*, one face of the flange 38 is juxtaposed to the outer face of the end wall 16. The complementing end flaps 20 are then folded onto the end wall 16 so that the cutouts 32*b* in the end flaps 20 form around the perimeter of the portion 36*a* of the grip 36. The portion 36*a* of the grip 36 projecting outwardly from the second face of the flange 38 is seated within the cutouts 32*b* in the end flaps 20 as shown in FIG. 3, and a small portion of the end flaps 20 snap over the inside of the longitudinally extending rib 36*e* between ribs 36*d*, thereby to hold the flaps 20 in an assembled relationship relative to the end wall 16 until the flaps and end walls are subsequently welded or otherwise fixedly secured together. An inner face of the end flaps 20 is juxtaposed to the outer face of the flange 38 when the handle 34 is positioned as described and shown in FIG. 8.

An upper portion 39 of the flange 38 projects upwardly from the aperture 32 toward the top edge 42 of the box 10 so that when a top rail 40 is pressed down onto the top edge 42 of the erected tote box 10, a downwardly open channel 48, formed between channel side walls 50 of a top rail 40, captures the upper portion 39 of the flange 38 along with the top edge 42 and tabs 22 on the end wall 16 as shown in FIG. 7. As a result, the handle 34 is securely retained in the aperture 32 of the tote box 10 and is prevented from inadvertently being removed or dislodged from the tote box 10 during use.

Figure 2:
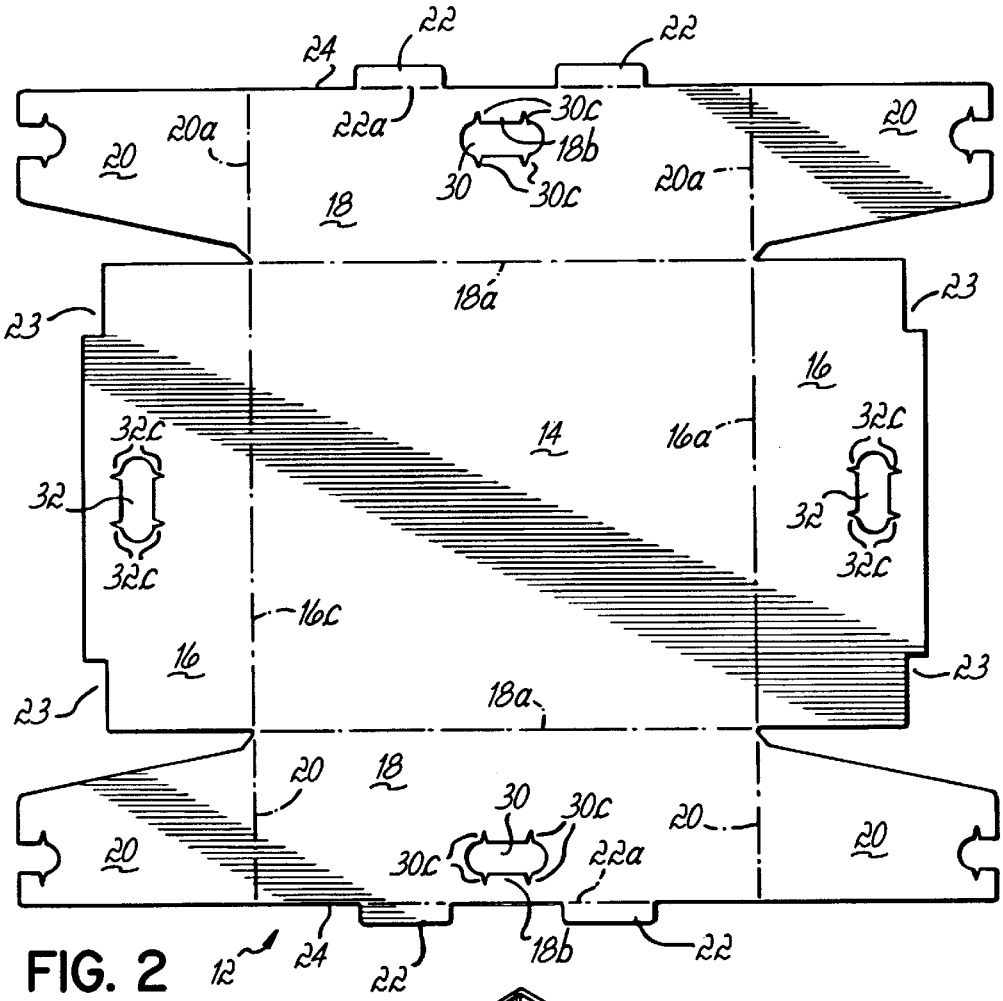
FIG. 2 is a top plan view of a box blank used to form the tote box of FIG. 1.

Embodiments of the inventive handle 44 according to the principles of this invention are shown in detail in FIGS. 5A, 5B, 6A, 6B, 7A, 7B, 7C, and 9, and are particularly useful on a single-ply wall, such as the side wall 18, shown in FIGS. 1–3. As discussed further below, the inventive handle structure may be utilized to secure a top edge structure such as a rail with the box structure. The invention may also be utilized alone to secure an edge structure and complement or enhance the anchoring or securement provided by the tote box itself, such as by tabs 22.

Figure 5A:
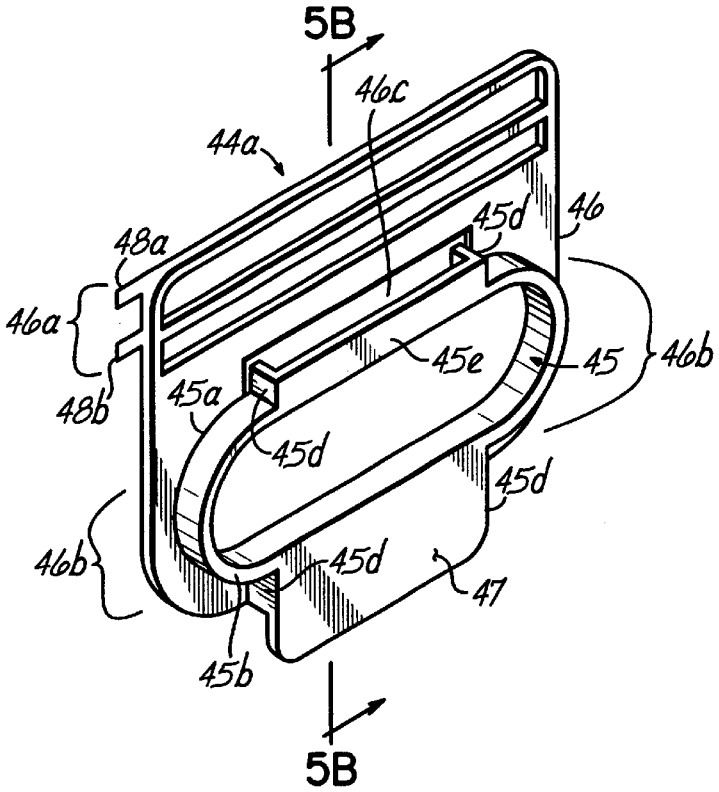
FIG. 5A is a perspective view of another embodiment of a handle in accordance with the principles of the present invention.
Figure 5B:
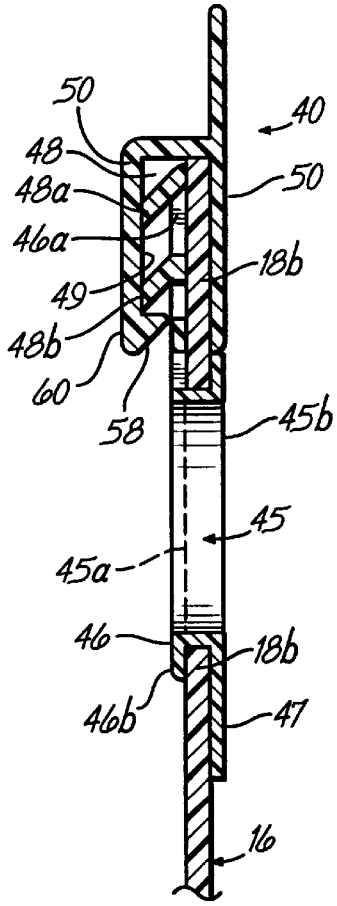
FIG. 5B is a side view illustrating the handle of FIG. 5A installed within a tote box with a cross section of the handle being shown along lines 5B—5B of FIG. 5A.

FIGS. 5A, 5B illustrate one embodiment 44*a* of the invention. The embodiment of the handle 44 includes an oval shaped grip 45 with a first, or inside, flange 46 extending from an inner edge 45*a* of the grip 45 perpendicularly with respect thereto. The first, or inside, flange 46 projects around both sides and the top and bottom of the grip 45, and has an upper portion 46*a* extending above the grip 45, and side and lower portions 46*b*, as shown in FIG. 5A. The embodiment of the handle 44 also includes a second, or outside, flange 47 which projects downwardly proximate an outside edge 45*b* of the grip 45. As shown in the drawings, the inner and outer flanges 46, 47 are illustrated as somewhat rectangular, but it will be appreciated by one of ordinary skill in the art that other configurations are possible within the scope of this invention. Furthermore, the grip is shown as being open into the box. However, alternatively, the grip might be closed at its inside face, so that the grip provides a shape for a finger hold, but does not open into the box.

The handle 44*a* has on the top and bottom sides of the grip 45 a pair of spaced transverse ribs 45*d*. The bottom pair of transverse ribs 45*d* are interconnected on the outside edge of grip 45 by the flange 47 and the top pair of transverse ribs 45*d* are interconnected by a longitudinally extending rib 45*e* which rib 45*e* extends upwardly from the outside edge 45*b* of the grip 45 so that the flange 47 and the longitudinally extending rib 45*e* are generally located in the same vertical plane. Cutouts, or apertures 46*c* are formed in the inner flange 46, and are positioned generally between the transverse ribs 45*d* and the opposite longitudinal rib 45*e* on both the top and bottom sides of the grip 45.

Prior to securing the top rail 40 to the tote box 10, handle 44*a* is positioned to engage the aperture and is, for example, snap-fit into the aperture 30 in the side wall 18 of the tote 10 so that an outer face of the first flange 46 is positioned along an inner face of the side wall 18 and the outer perimeter of the grip 45 is snugly received within the aperture 30. An inner face of the second flange 47 is positioned along an outer face of the side wall 18 when the handle 44*a* is inserted into the aperture 30 (FIG. 5B). When thus engaging the aperture 30 of the side wall 18, a downwardly extending portion 18*b* of the side wall 18 between two triangular notches 30*c* extends downwardly and is entrapped between transverse ribs 45*d* and the longitudinal rib 45*e* on the outside face of the side wall 18 and the flange 46 on the inside face of the side wall 18. An upwardly extending portion 18*b* between notches 30*c* extends and is entrapped between the lower transverse ribs 45*d* and the flange 47 on the outside face of the sidewall. The lower transverse ribs 45*d* extend between the flanges 46 and 47.

Referring again to FIGS. 5A and 5B, protruding structures are coupled with the handle and in the Figures are shown on flange 46 of the handle embodiment 44*a*. Specifically, protruding structures in the form of tongues 80*a*, 80*b* are shown extending or upstruck from a portion of the handle, such as flange 46. As discussed further hereinbelow, and as shown in the drawings, in one aspect of the invention, the protruding structures are configured to engage the top rail and secure the handle 34 with the top rail 40 and secure the top rail with the overall tote box structure. The embodiment in the drawings illustrates two tongues, 80*a* and 80*b*, although a single tongue or a greater number of tongues might also be used.

The tongues 80*a*, 80*b* are molded integrally with the handle 34 in one embodiment. For example, they may be molded as shown at an angle to the plane of flange 46. Alternatively, the tongues might be stamped from the flange and bent to extend away from the plane of flange 46. Still further, the tongues might be separately formed and then secured to or coupled to handle 44*a* (see FIG. 10). The protruding structures are angled from the plane defined by the handle, which generally coincides with a plane defined by the end wall or side wall of the box in the FIGS. 5A, 5B. The tongues are angled inwardly toward the inside of the box structure 10 to engage an inner channel wall 50 of the top rail.

Figure 10:
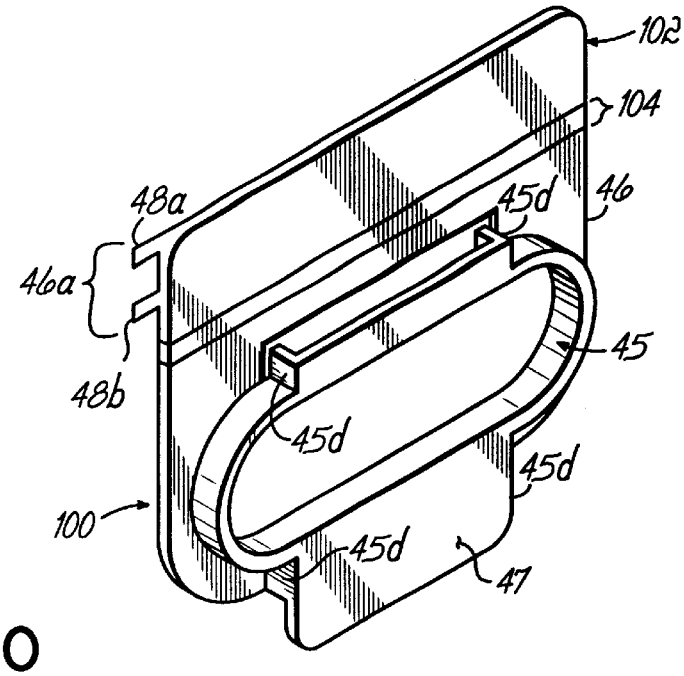
FIG. 10 is a perspective view of another embodiment of the invention.

FIG. 10 illustrates an alternative embodiment of the invention wherein a handle portion and a portion containing one or more protruding structures are separate pieces. Specifically, in the alternative embodiment, a handle portion 100 may be operably coupled together with a protruding structure portion 102. The handle portion 100 may resemble, in part, the handle configurations illustrated herein. For example, handle portion 100 might be similar to parts of the handle embodiment 44*a* illustrated in FIGS. 5A and 5B. Therefore, similar reference numerals are utilized.

In accordance with one aspect of the invention, the handle portion 100 and protruding structure 102 may be coupled together, such as utilizing structure 104 between the two portions. Structure 104 could be any suitable securement means, coupling means, or fastening means for coupling portion 100 with portion 102 so that the overall handle structure 44*d* operates to secure the top rail with the box structure and secure the handle with the top rail in the completed tote box assembly. Therefore, the operation or configuration of the structure 104 is not limited.

Figure 8:
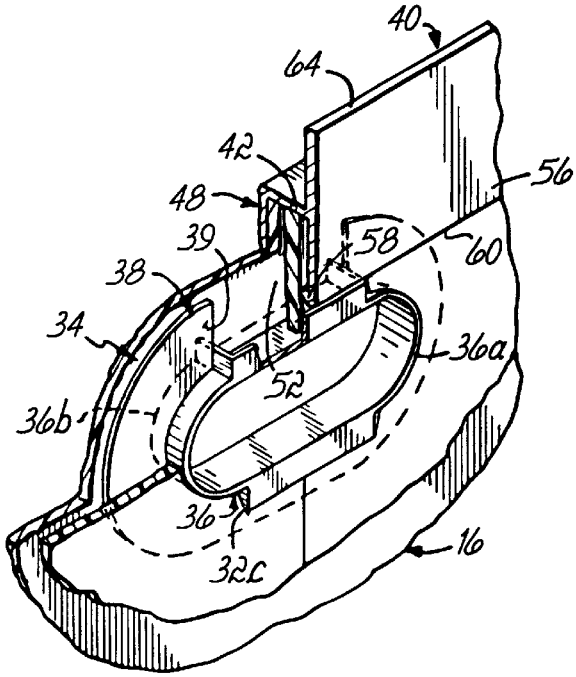
FIG. 8 is a perspective view of the handle of FIG. 4 assembled in a two ply wall of the tote box illustrated in FIG. 1.

The upper portion 46*a* of the first flange 46 extends upwardly from the aperture 30 and is captured between the channel walls 50 of the top rail 40 as shown in FIGS. 5B and 8. It will be appreciated by one of ordinary skill in the art that the width of the channel 48 formed between the channel walls 50 of the top rail 40 should be sufficiently sized to accept the flange 46 or 38 from either embodiment of the handle 34 or 44*a*, 44*b* and the protruding structures, along with the single or double ply of the wall 16 or 18 of the tote box 10 and the tab 22 folded thereon.

Figure 9:
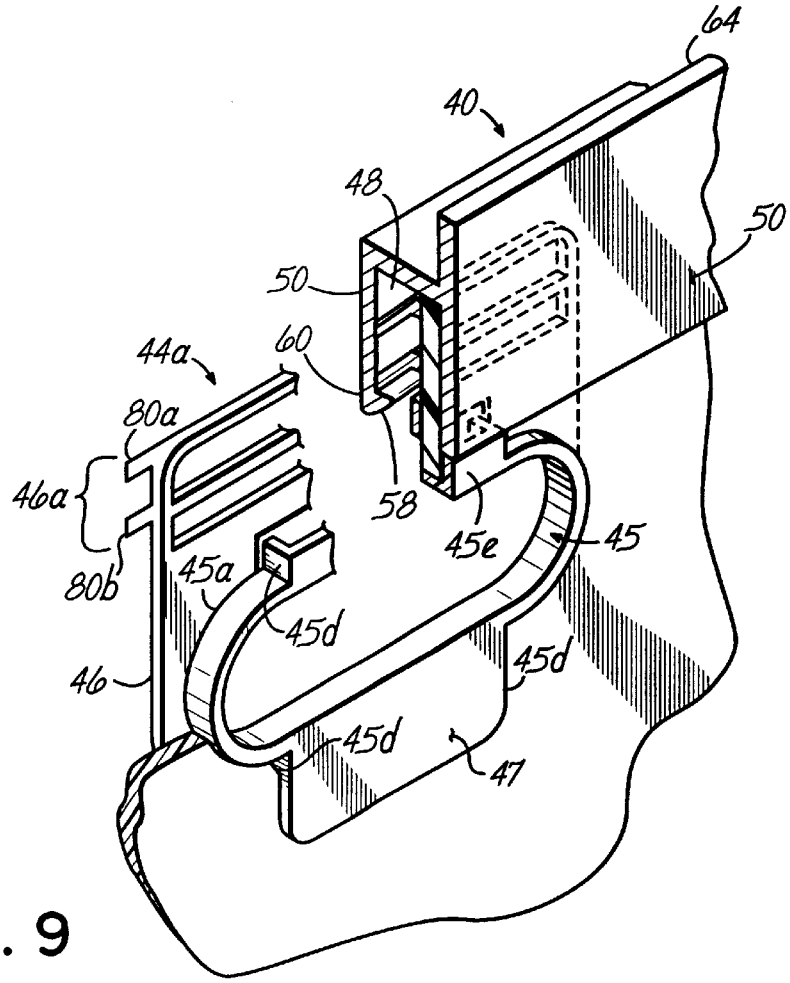
FIG. 9 is a perspective view of a handle of FIG. 5A assembled in a single ply wall of the tote box.

Turning to FIGS. 5B and 9, the tongues 80*a*, 80*b* engage top rail 40 and specifically engage of an inside channel wall 49. In one embodiment, an inwardly extending hook 58 is positioned on a bottom edge 60 of at least one of the channel walls. The hook 58, shown on the inside wall 49, extends inwardly facing the tongues 80*a*, 80*b*. One of the tongues 80*a*, 80*b* engages the hook 58 and secures or locks the handle 44*a* together with the top rail 40 and the box structure 10. In one embodiment, the tongues are flexible, and they flex so that the flange 46 and tongues can slide into channel 48 when the top rail is assembled with the box structure. The tongues then flex back outwardly to engage wall 49 and hook 58. Multiple hooks 58 or other catch structures might be used with rail 40, although only one hook is shown in FIGS. 5A, 5B.

The side tabs 22*a*, 22*b* for the box embodiment shown in FIG. 1 are also folded downwardly toward the inside of the box structure 10 in order to also engage the hook and further secure the top rail to the box structure. In that way, the top rail is held in place and secured with the box structure by not only the tabs of the box structure walls, but also by handle 44. As such, the invention provides a robust and durable tote box wherein the handle is locked into the walls of the tote box and the top rail. As shown in FIG. 1, the tabs 22*a*, 22*b* are spaced apart enough to allow the tongues 80*a*, 80*b* or other protruding structures to engage the top rail without interference with the box structure walls. Handles 44 are positioned in opposite side walls 18.

In another embodiment of the invention, the box may not include tabs 22. In such an embodiment, the handles 44*a* would secure the rail with the box in the completed assembly. Therefore, one particular advantage of the invention is the ability of the inventive handles to secure the rail with the box by themselves, or to enhance other securement structures, such as tabs 22. Even if tabs 22 are present in one or more of the box sides, this operation may be enhanced with additional securement structures of the inventive handles. For example, the box blank 12 may be made of a corrugated material with corrugations along the length of the blank. As may be appreciated, such corrugations are going to add rigidity and strength to structures like tabs 22 when they run perpendicular to the fold lines or the length of the tabs. However, this will only occur at two sides of the box blank. For the other opposing sides where the corrugations run generally parallel to the fold lines, the securement of the rail with the tabs may be enhanced by the handle 44 and the protruding structures 48*a*, 48*b*. In that way, the rail is strongly secured on all sides of the box.

In the Figures, the embodiment shown has protruding structures which extend inwardly and engage a hook 58 or channel wall 49 on the inside of the tote box. Alternatively, the protruding structures might extend outwardly and engage a hook or channel wall on the outside of the tote box. For example, the handle may be turned around to have protruding structures extending outwardly. As may be appreciated, the rail may have to be reconfigured so that the outward protruding structures may engage and secure the rail.

Figure 6A:
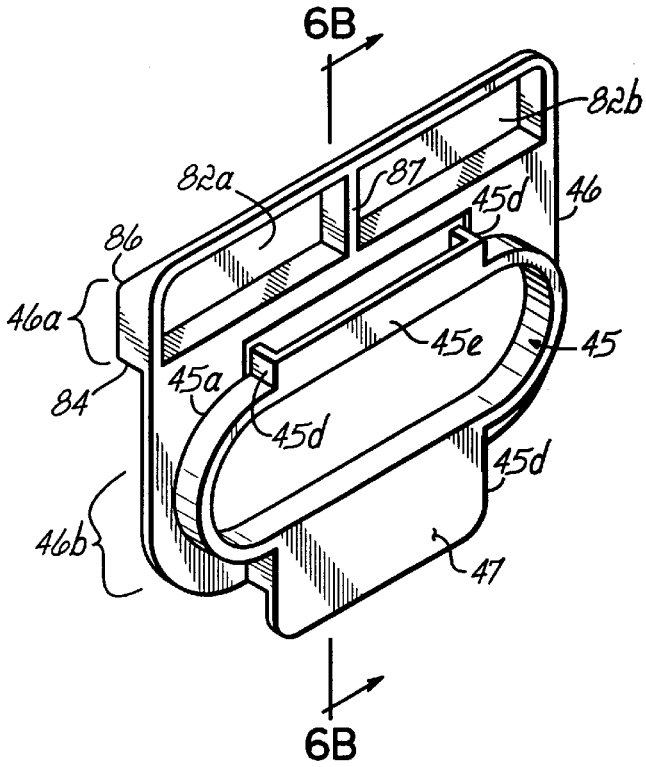
FIG. 6A is a perspective view of another embodiment of a handle in accordance with the principles of the present invention.
Figure 6B:
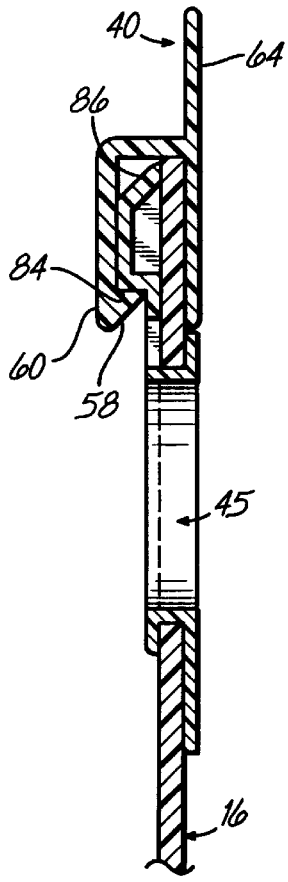
FIG. 6B is a side view illustrating the handle of FIG. 6A with a cross section of the handle being shown along lines 6B—6B of FIG. 6A.

FIGS. 6A and 6B illustrate an alternative embodiment of a handle of the invention. The handle 44*b* is constructed with some similarity to handle 44*a*. Therefore, like numerals are used for like elements between the two embodiments. The protruding structures of handle 44*b* are in the form of one or more indents 82*a*, 82*b* which are formed in the handle structure, such as in the flange 46 to extend from a plane defined by the handle, which coincides with the plane defined by the box wall. The indents extend toward one of said channel walls, such as inside wall 49. The indents 82*a*, 82*b* form a generally horizontal surface, or catch surface, 84. When the flange 46 and indents 82*a*, 82*b* are positioned in channel 48, the surface 84 engages the hook 58 and secures the handle 44*b* in the top rail 40. A sloped surface 86 allows the rail to be slid over the handle and indents and snapped into place as shown in FIG. 6B. The indents 82*a*, 82*b* are shown as separate indents which share a rib or wall 87. Alternatively, a single indent might be found along the handle 44*b*. Also, the indents 82*a*, 82*b* are shown as integrally formed with the handle. Alternatively, they might be formed separately and then secured or coupled to the handle (see FIG. 10).

The handle 44*b* as illustrated in FIG. 6A, 6B is assembled with tote box 10 similar to the handle 44*a* discussed above. The indents are configured to engage the wall 49 of channel 50.

To assemble the tote box 10, the side walls 18 are first folded upward. The handles 44 can then be inserted into the aperture 30 in the side wall 18 as described hereinabove. Next, the end walls 16 are folded upward, the end flaps 20 are then folded inwardly, and the handles 34 inserted into the apertures 32 in the end walls 16, as described hereinabove.

Once the side walls 18 and the end walls 16 are erected and the handles 34, 44 inserted as previously described, the corner enhancers 26 are inserted into each corner of the erected tote box 10 such than an outside surface 51 of the first corner enhancer leg 28*a* is parallel to the side wall 18 and adjacent to the inside surface of that side wall 18. An inside surface 53 of the second corner enhancer leg 28*b* is parallel to the erected end wall 16 and is adjacent to the outside surface of that end wall 16. The corner enhancer 26 is thereby sandwiched with the second corner enhancer leg 28*b* between the end wall 16 and the end flap 20.

The top rail 40 is then snapped onto a top edge 42 of the erected box 10 and over the protruding structures of the handle. The top edge 42 is formed from a top edge of each end wall 16 and each side wall 18. Prior to securing the top rail 40, the tabs 22*a*, 22*b* (if present) must be folded downwardly upon the side walls 18. Once the tabs 22 are folded downwardly, the unitary top rail 40 can be snapped onto the top edge 42 of the erected tote box 10, and over the protruding structures to engage the protruding structures and part of the flanges 46 of each handle 44*a*, 44*b*. Of course, without the tabs 22, the rail is engaged primarily by the protruding structures of the handles. The top rail 40 has a downwardly open channel 48 which is formed by two spaced channel walls 50 as shown in FIGS. 5B, 6B, 7C, and 9. The channel 48 has an opening of a width sufficient to grip the multi-ply top edge of the box 10 and the upper portion 39 or 46*a* of the flange 38 or 46. The channel opening is of sufficient width to accommodate the upper portion 46*a* of the flange 46, the protruding structures, the side wall 18 and any tab 22 folded thereon in a first section 54 of the top rail 40, and the end wall 16, upper portion 39 of the flange 38 and end flap 20 folded thereon in a second section 56 of the top rail, all as shown in FIGS. 8 and 9. The notches 23 permit the channel opening 52 to conveniently fit over the end flap 20 and the corner enhancer leg 28*b* in this region of the erected tote box 10 without the interference of the end wall 16.

Again, an inwardly extending hook 58 is provided on a bottom edge 60 of at least one channel wall 50. When the top rail 40 is snapped onto the erected tote box 10, one of the hooks 58 engages a bottom edge 62 of any downwardly folded side tab 22 and engages the protruding structures, thereby securing the top rail 40 on the erected tote box 10, as shown in FIG. 3. Once the top rail 40 is pressed onto the top edge 42 of the tote box 10 and one of the hooks 58 engages the protruding structures, the tote box 10 is erected without the benefit of mechanical fasteners, rivets, staples, or the like. While the tab 22 is illustrated in FIG. 1 as being folded downwardly on the inside of the side wall 18, it could just as well be folded down on the outside of this same wall. In such a case, it would engage a hook utilized on the outside channel wall.

Figure 7A:
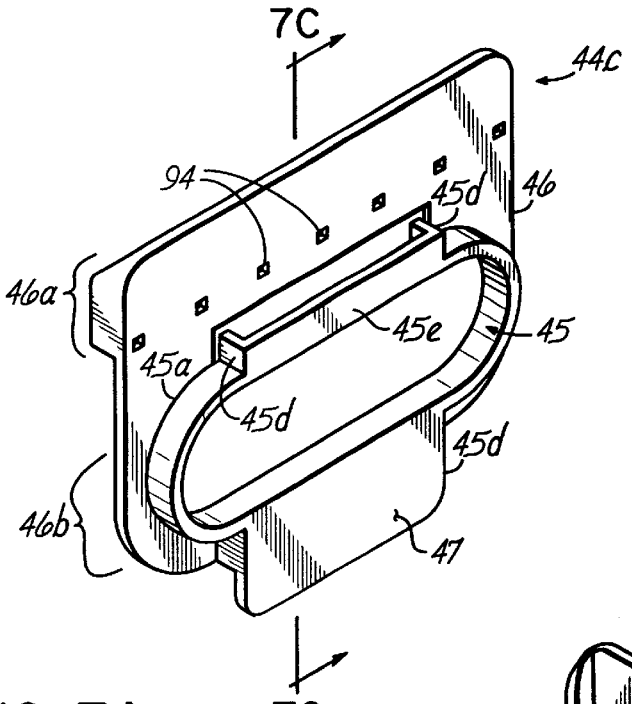
FIGS. 7A and 7B are perspective views of opposite sides of another embodiment of a handle in accordance with the principles of the present invention.
Figure 7B:
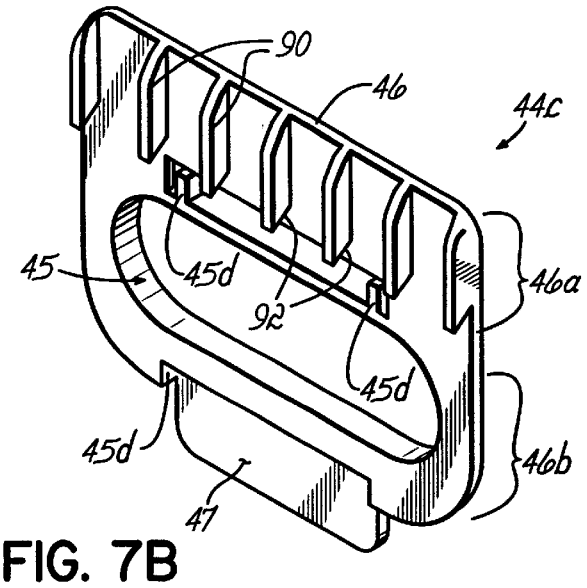
Figure 7C:
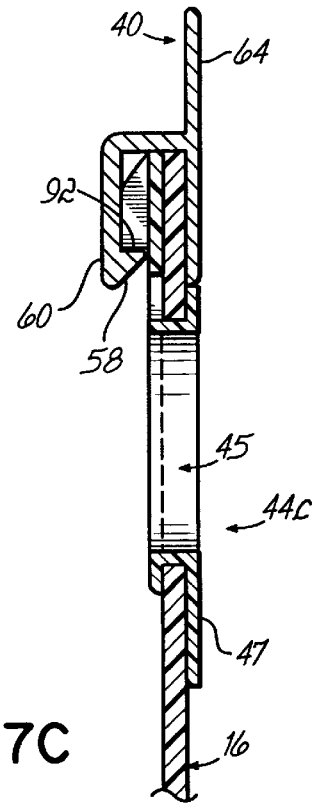
FIG. 7C is a side view illustrating the handle of FIGS. 7A, 7B with a cross-section of the handle shown along lines 7C—7C of FIG. 7A.

FIGS. 7A, 7B, and 7C illustrate another embodiment of a handle of the invention. The handle 44*c* is constructed with some similarity to the previously described handles 44*a* and 44*b*. Therefore, like numerals are used for like elements between the various embodiments. The protruding structures of handle 44*c* are in the form of a plurality of ribs 90 which extend from the upper portion 46*a* of the flange 46. The ribs have catch surfaces 92 which engage the hook or catch structure 58 of rail 40. The ribs 90 may be integrally molded with the handle and flange 46. Alternatively, the ribs might be contained on a separate piece which couples with the handle 44*c* in the completed tote box (see FIG. 10). Handle 44*c* is installed within the tote box wall, as discussed above, with respect to the other embodiments. The ribs 90 act to engage the rail 40 to secure the rail to the tote box and also to secure the handle within the tote box. Referring to FIG. 7A, apertures 94 might be utilized in the flange portion 46*a* to accommodate a tool, such as a molding tool. As illustrated in FIG. 7B, a plurality of ribs 90 are utilized in one embodiment, and are spaced along the length of the handle 44*c* for providing proper securement and engagement between the handle 44*c* and top rail 40.

The top rail 40, according to one embodiment of the present invention, has a vertically extending lip 64 on an outside upper edge thereof. The lip 64 facilitates the stacking of a second tote box in a nested relationship upon a tote box 10 of the present invention. The weight of the tote box stacked on the top rail 40 is distributed around the top rail 40 and supported by the corner enhancers 26 of this embodiment of the present invention. It will be appreciated that other configurations and embodiments of tote boxes and handles can be used within the scope of the appended claims.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A tote box comprising:

a box structure having a bottom and side walls, the side walls having upper edges which form a top edge of the box structure;

an aperture formed in at least one of said side walls of the box structure;

a top rail engaging the top edge of the box structure, the top rail including an open channel and a pair of channel walls and at least one of the channel walls including an inwardly extending hook;

a handle positioned to engage the aperture in the at least one side wall to form a handle for the box structure;

a flange coupled with the handle and extending between the channel walls;

at least one protruding structure extending outwardly from the flange and configured to engage the hook of the channel wall and secure the top rail with the box structure.

2. The tote box of claim 1 wherein the protruding structure is integrally formed with the handle.

3. The tote box of claim 1 further comprising multiple protruding structures coupled with the handle and configured to engage the top rail.

4. The tote box of claim 1 wherein the hook is positioned on a bottom edge of at least one of said channel walls.

5. The tote box of claim 1 wherein said protruding structure includes at least one upstruck tongue.

6. The tote box of claim 1 wherein said protruding structure includes multiple upstruck tongues.

7. The tote box of claim 1 wherein said protruding structure includes at least one indent.

8. The tote box of claim 1 wherein said protruding structure includes an at least one rib.

9. The tote box of claim 1 wherein said handle further comprises a second flange extending downwardly opposite the flange and extending along the side wall.

10. The tote box of claim 1 wherein the flange extends substantially around said handle and the aperture it engages.

11. The tote box of claim 1 wherein the handle and the protruding structure are separate pieces and are coupled together for securing the handle with the top rail.

12. The tote box of claim 1 further comprising multiple handles positioned to engage respective multiple apertures in the side walls to form multiple handles for the box structure;

multiple protruding structures each coupled with a respective handle and configured to engage the top rail and secure the top rail with the box structure.

13. A tote box comprising:

a box structure having a bottom and upstanding side walls defining a top edge;

a top rail extending around the top edge of the box structure, the top rail including an open channel and a pair of channel walls and a hook extending inwardly from at least one of the channel walls;

a handle configured to engage at least one of the side walls to form a handle for the box structure;

a flange coupled with the handle and extending between the channel walls;

at least one protruding structure outwardly from the flange and configured to engage the hook of the channel wall and secure the handle with the top rail on the box structure.

14. The tote box of claim 13 wherein said protruding structure includes at least one tongue.

15. The tote box of claim 13 wherein said protruding structure includes an at least one indent.

16. The tote box of claim 13 wherein said protruding structure includes an at least one rib.

17. A tote box comprising:

a box structure having a bottom and side walls, the side walls having upper edges which form a top edge of the box structure;

an aperture formed in at least one of said side walls of the box structure;

a top rail engaging the top edge of the box structure;

a handle positioned to engage the aperture in the at least one side wall to form a handle for the box structure;

at least one protruding structure coupled with the handle and configured to engage the top rail and secure the top rail with the box structure;

the handle and the protruding structure being separate pieces and coupled together for securing the handle with the top rail.

18. A method of constructing a tote box comprising:

forming a box structure having a bottom and side walls which define a top edge, an aperture being formed in at least one of the side walls;

positioning a handle to engage the aperture in the at least one side wall to form a handle for the box structure, the handle including a flange;

positioning a top rail to extend around the top edge of the box structure, the top rail including an open channel formed by channel walls and a hook extending inwardly from at least one of the channel walls;

positioning the top rail over the flange and engaging the top rail hook with a protruding structure extending outwardly from the flange to secure the top rail with the box structure.

19. The method of claim 18 wherein the protruding structure is integrally formed with the handle.

20. The method of claim 18 wherein said protruding structure includes a at least one tongue.

21. The method of claim 18 wherein said protruding structure includes an at least one indent.

22. The method of claim 18 wherein said protruding structure includes an at least one rib.

23. The method of claim 18 wherein the handle and protruding structure are separate and further comprising coupling the handle with the protruding structure to secure the top rail with the box structure.

24. A method of constructing a tote box comprising:

forming a box structure having a bottom and side walls which define a top edge, an aperture being formed in at least one of the side walls;

positioning a handle to engage the aperture in the at least one side wall to form a handle for the box structure;

positioning a top rail to extend around the top edge of the box structure;

coupling a protruding structure with the handle;

engaging the top rail with the protruding structure to secure the top rail with the box structure.

* * * * *